US011603303B2

(12) United States Patent
Gilbert

(10) Patent No.: US 11,603,303 B2
(45) Date of Patent: Mar. 14, 2023

(54) DEVICE AND METHOD FOR FIRMLY GRIPPING AN OBJECT, SUCH AS A CONTAINER OR JAR

(71) Applicant: John S. Gilbert, Somers, NY (US)

(72) Inventor: John S. Gilbert, Somers, NY (US)

( * ) Notice: Subject to any disclaimer, the term of this patent is extended or adjusted under 35 U.S.C. 154(b) by 217 days.

(21) Appl. No.: 15/906,356

(22) Filed: Feb. 27, 2018

(65) Prior Publication Data

US 2019/0210857 A1 Jul. 11, 2019

Related U.S. Application Data

(60) Provisional application No. 62/614,622, filed on Jan. 8, 2018.

(51) Int. Cl.
*B67B 7/18* (2006.01)

(52) U.S. Cl.
CPC ..... *B67B 7/186* (2013.01)

(58) Field of Classification Search
CPC ..... B67B 7/186
See application file for complete search history.

(56) References Cited

U.S. PATENT DOCUMENTS 876,469 A * 1/1908 Martin et al. ..... B25B 13/52 81/64
1,348,532 A * 8/1920 Arndt ..... B67B 7/186 81/3.43
1,646,661 A * 10/1927 Richard ..... B67B 7/186 81/3.43
1,726,862 A * 9/1929 Schustarich ..... B67B 7/186 81/3.43
1,774,201 A * 8/1930 Jenkins ..... B67B 7/186 81/3.43
1,916,554 A * 7/1933 Bevington ..... B67B 7/186 81/3.43
2,013,209 A * 9/1935 Hargreaves ..... B67B 7/186 81/3.43

(Continued)

FOREIGN PATENT DOCUMENTS

CN 107176570 A 9/2017

*Primary Examiner* — Daniel Jeremy Leeds
(74) *Attorney, Agent, or Firm* — TaeRa K. Franklin; Eckert Seamans Cherin & Mellott, LLC

(57) ABSTRACT

A strap wrench device includes (a) an elongate, flexible member having a first end and a second end; and (b) an elongate handle having a proximal end, a distal end, a face side and a back side. The handle is configured to be conveniently held in a user's right hand with its proximal end extending toward the object to be gripped. The proximal end of the handle has a means on its right side (when held by a user with its the face side upward) for attaching the first end of the flexible member. It also has an opening adjacent the handle's left side through which the second end of the flexible member can pass. The flexible member extends through the opening in the handle, thereby forming a loop that can surround and grip an object. The flexible member then extends further along the left side of the handle toward the handle's distal end. The handle includes a rounded protrusion at its proximal end, adjacent to the opening and on a side of the opening that is opposite to the flexible member attachment means, for pressing the flexible member against the gripped object when the device is in use.

9 Claims, 7 Drawing Sheets

(56) References Cited

U.S. PATENT DOCUMENTS 2,132,207 A * 10/1938 Donovan ..... B25B 13/52 81/3.43
2,181,012 A * 11/1939 Bunting ..... B25B 13/52 81/64
2,389,301 A * 11/1945 Escher ..... B67B 7/186 81/3.43
2,557,601 A * 6/1951 Hebden, Jr. ..... B67B 7/186 81/3.43
4,145,938 A * 3/1979 Laird, Jr. ..... B25B 13/52 81/64
4,987,804 A * 1/1991 Greenawalt ..... B25B 13/52 81/3.43
5,097,729 A * 3/1992 Brown ..... B67B 7/186 81/3.43
5,704,258 A 1/1998 Lavoie
6,101,903 A * 8/2000 Negley ..... B25B 13/52 81/3.43
6,125,723 A * 10/2000 Huang ..... B25B 13/52 81/3.43
6,425,305 B2 7/2002 Gasparre
6,427,561 B1 * 8/2002 Huang ..... B25B 13/52 81/64
6,789,450 B1 * 9/2004 Helfet ..... B25B 13/52 81/3.43
6,834,568 B2 * 12/2004 Khubani ..... B25B 13/52 81/3.43
8,517,732 B2 * 8/2013 Segal ..... A61C 5/85 433/155
2002/0178868 A1 * 12/2002 Davidson ..... B67B 7/186 81/3.43
2004/0124648 A1 * 7/2004 Williams ..... B66C 1/62 294/86.4
2006/0112792 A1 * 6/2006 Ping ..... B25B 27/0042 81/3.43
2013/0298508 A1 11/2013 Metcalf
2016/0303716 A1 * 10/2016 Abras ..... B67B 7/186

* cited by examiner

DEVICE AND METHOD FOR FIRMLY GRIPPING AN OBJECT, SUCH AS A CONTAINER OR JAR

BACKGROUND OF THE INVENTION

The present invention relates to a wench device for firmly gripping an object such as a container or jar. The invention further relates to a method of using such device for opening the lid of a container or jar.

Numerous devices have been devised for gripping an object such as a container or jar to facilitate opening a lid. The U.S. patent publication No. 2013/0298508, for example, discloses a "strap wrench" that can be applied to either a jar or a jar lid to firmly hold and to apply a torque to open the lid. In one embodiment two strap wrenches are used to allow a user to firmly hold the jar with one hand while applying torque to open the lid with the other.

Other devices for opening the lid of a jar may be found in the following patent references:

CN107176570 for "Bottle Cap Unscrewing Device";

US2006011792 for "Strap Wrench";

U.S. Pat. No. 6,425,105 for "Jar Holder"; and

U.S. 5,704,258 for "Bottle Opening Device".

As evidenced by all of these references, so-called "strap wrench" has been frequently used to hold a container or jar to aid the user in opening the lid. This device was originally designed to grip an industrial object, such as a water pipe or an oil filter, with a relatively wide strap in order to hold or turn the pipe or filter while avoiding scarring, as would occur from the use of a toothed pipe wrench. The wrench's strap is its contact with nearly the entire circumference of the round object, and thus can apply the torsional force received from the handle which serves as a lever and that, depending on its length, multiplies the mechanical advantage.

Strap wrenches are commercially available wherever tools are sold. One such wrench, made by Flui-Pro Products, is the "Heavy-Duty Rubber Strap Wrench with Locking Non-Slip Grip." This strap wrench has a plastic handle and a strap of sufficient length to surround a six-inch pipe or filter. While both economic and sturdy, this wrench requires some dexterity and manipulation to use because the strap must first be passed around the object to be gripped and then held tightly against the handle by a ratcheting mechanism. To undo the strap the ratcheting mechanism must first be released.

When opening the screw-cap lid of a container, torque must be applied in opposite directions to the lid, on one hand, and to the container on the other. Especially in the case of vacuum-packed food containers, the torque required is significant and, in particular for children and people of advanced age, the lid may be difficult to open.

The aforementioned patent publication No. 2013/0298508 proposes to solve this problem by using a strap wrench attached to the lid (FIG. 3), or by using two strap wrenches: one attached to the lid and another to the jar (FIG. 4 of the publication). In the former case, the jar is held in one hand while the wrench is turned with the other. In the latter a one wrench is held stationary with one hand while the other wrench is turned by the other, free hand. Neither one of these proposed maneuvers is entirely satisfactory and convenient.

SUMMARY OF THE INVENTION

A principal object of the present invention, therefore, is to provide an improved wrench device for firmly gripping are object, such as a container or jar, which is effective and robust, yet extremely convenient to use.

Another, ancillary object of the present invention is to provide method of using the improved wrench device to unscrew the lid of a container or jar.

These objects, as well as further objects which will become apparent from the discussion that follows, are achieved by providing a strap wrench device of the type described above that includes:

(a) an elongate, flexible member having a first end and a second end; and (b) an elongate handle having a proximal end, a distal end, a face side and a back side. The handle is configured to be conveniently held in a user's right hand with its proximal end extending toward the object to be gripped. The proximal end of the handle has a means on its right side (when held by a user with its face side up) for attaching the first end of the flexible member. It also leas an opening adjacent the handle's left side through which the flexible member can pass.

The flexible member extends through the opening in the handle, thereby forming a loop that can surround and grip the object. The member then extends further along the left side of the handle toward the handle's distal end.

In accordance wait the invention, the handle includes a rounded protrusion at its proximal end, adjacent to the opening and on a side of the opening that is opposite to the flexible member attachment means, for pressing the flexible member against the gripped object when the device is in use.

This protrusion serves as a means for "locking" the flexible member, and preventing slippage of the loop with respect to the object when the handle is rotated clockwise.

The flexible member is preferably a substantially flat strap, because such would provide a maximum contact area with the object to be gripped. In this case, the opening in the handle is preferably a slit which accommodates the strap with minimum clearance so as to guide and hold the strap in position adjacent the object.

Preferably also, the flexible member has a rubber surface side thereof in contact with the object so as to prevent slippage.

In a preferred embodiment of the invention, the rounded a formed by an elongate hump that extends across the width of the handle, from its face side to its back side. This configuration distributes the force applied to the strap across the width of the strap.

Advantageously, the handle of the wrench device is made of a hard plastic, and the rounded protrusion is made of a different material than the handle, such as metal or rubber, and attached to the plastic handle either during or after the handle is cast in a mold. In this way, the protrusion can be configured to best serve its purpose as an abutment that maintains the strap in position even when a substantial torque force is applied to the wrench during use.

According to a other preferred embodiment, the wrench device further comprises a guide member affixed to the handle that extends outward therefrom on the left side thereof, for guiding and retaining the flexible member in close proximity to the handle. The guide member is preferably made of a bent metal rod that is embedded at one end in the plastic material of the handle.

Another aspect of the present invention concerns a method for opening a lid of a container, using the wrench device described above. It is assumed that the lid is substantially round and is screwed on tightly, as is often the case with jars of food. The container may be, but is not necessarily, cylindrical in share. It may be oval shaped, for instance, or even square.

The present method, which advantageously requires only a single wrench device, comprises the following steps:

(a) Surrounding the container with the flexible member, forming a snug loop around the container;

(b) With the left hand, grasping the container lid tightly between the left thumb and the left forefinger; and (c) Rotating the wrench device clockwise with the right hand, to rotate the container while firmly holding the lid stationary with the left hand.

In so doing the rounded protrusion presses against the flexible member, firmly fixing it in position and preventing slippage of the loop with respect to the container while the wrench device is rotated.

For a full understanding of the present invention, reference should now be made to the following detailed description of the preferred embodiments of the invention as illustrated in the accompanying drawing.

DETAILED DESCRIPTION OF THE PREFERRED EMBODIMENTS

Figure 1:
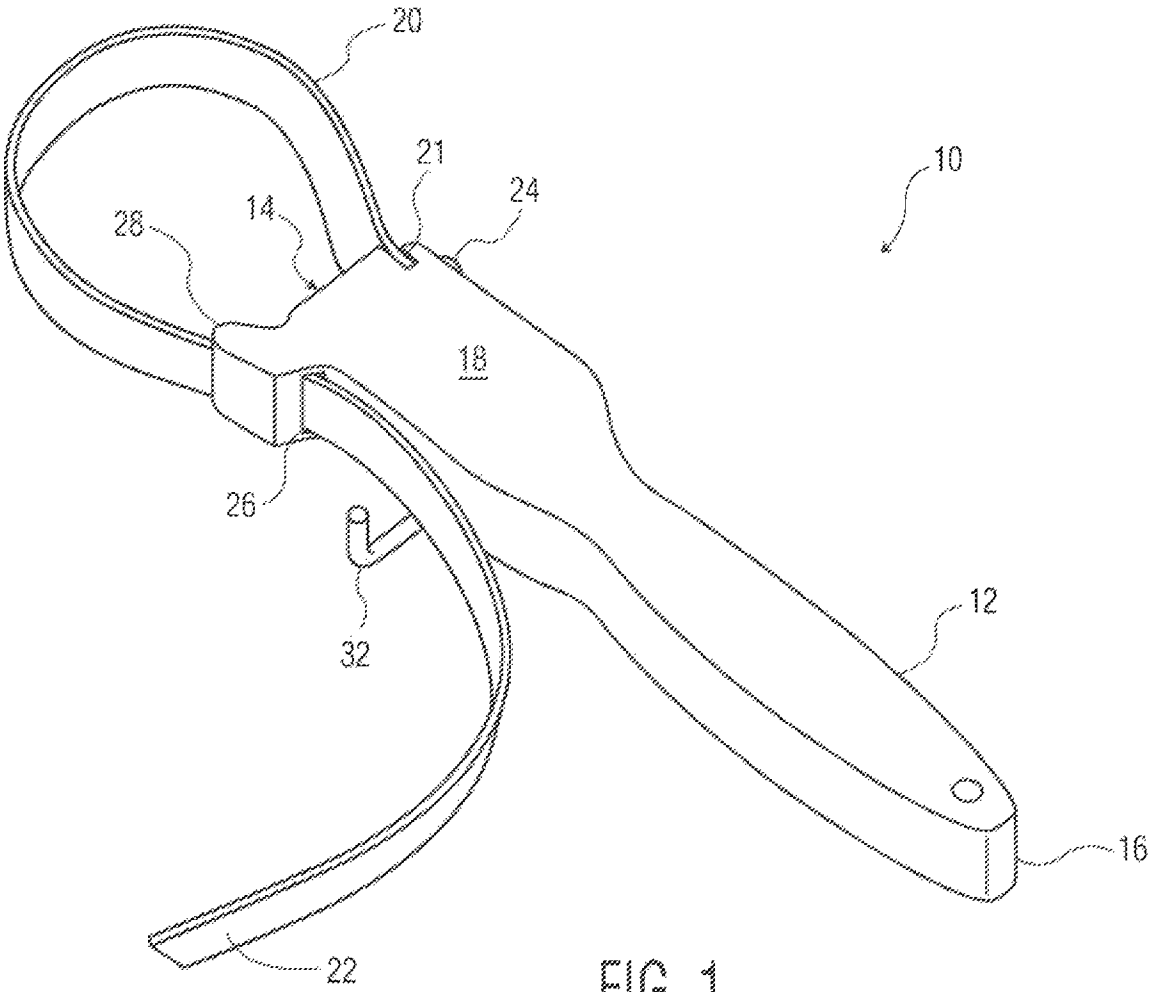
FIG. 1 is a perspective view showing a preferred embodiment of the wrench device according to the invention.

The preferred embodiment of the present invention will now be described with reference to FIGS. 1-6 of the drawings. Identical elements in the various figures are identified with the same reference numerals.

The wrench device according to the invention is shown generally in FIG. 1. A plan view of the device is shown in FIG. 2.

Figure 2:
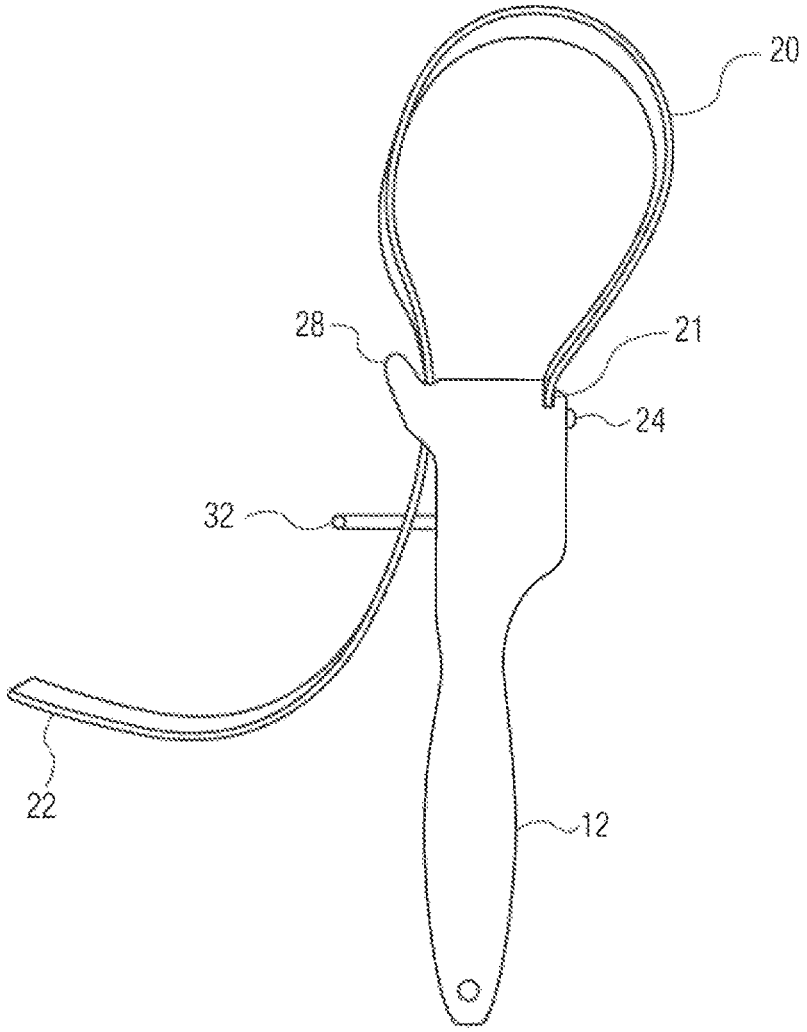
FIG. 2 is a face side view of the wrench device of FIG. 1.

Referring to FIGS. 1 and 2, the wrench device 10 is shown comprising an elongate handle 12 having a "proximal end" 14, a distal end 16, and a face side 18. The handle is configured to be conveniently held in a user's right hand with its proximal end extending toward an object to be gripped.

The device also includes a flexible member 20 (in this case a strap) having a first end 21 and a second end 22. The proximal end of the handle has a means 24 on its right side (as viewed when the device is held by a user with its the face side 18 upward) for attaching the first end of the flexible member. This means may be a rivet (as shown), an eyelet or any common device for "fixing" the first end of the member to the handle.

The flexible member 20 forms a loop and passes through an opening 26, preferably a narrow slit if the member is a flat strap, on the left side of the handle's proximal end. The member 20 then extends further along the left side of the handle toward the handle's distal end 16.

In accordance with the invention, the handle includes a rounded protrusion 28 at its proximal end 14, adjacent to the opening 26 and on the side of the opening that is opposite to the flexible member attachment means 24. This protrusion 28 presses the flexible member tightly against a gripped object when the device is in use, preventing slippage of the member with respect to the object when the handle is rotated clockwise.

The flexible member 20 is preferably a substantially flat strap, because such would provide a maximum contact area with the object to be gripped. In this case, the opening 26 in the handle 12 is preferably a slit which accommodates the strap with minimum clearance so as to guide and hold the strap in position adjacent the object.

Preferably also, the flexible member 20 has a rubber surface on its side that is in contact with the object, so as to maximize friction and minimize slippage.

In the preferred embodiment of the invention, the rounded protrusion 28 is formed by an elongate hump that extends across the width of the handle, from the face side to its back side. This configuration distributes the force applied to the strap across the width of the strap.

Preferably, the handle 12 of the wrench device 10 is made of a hard plastic. The rounded protrusion 28 can be formed integrally with the handle, as is shown in FIGS. 1 and 2. Alternatively, however, it can be made a separate element of a different material than the handle, such as metal or rubber. For example, the separate element can be in the form of a short round rod attached to the plastic handle 12 either during or after the handle is cast in a mold. In this way, the protrusion 28 can be configured to best serve its purpose as an abutment that maintains the strap in position even when a substantial torque force is applied to the wrench during use.

According to another preferred embodiment of the invention, the wrench device further comprises a guide member 32 affixed to the handle, that extends outward, therefrom on its left side, for guiding and retaining the flexible member 20 in close proximity to the handle. The guide member 32 may be made of a bent metal rod, for example, that is embedded and thereby freed at one end in the plastic handle.

Another aspect of the present invention concerns a method for opening a lid of a container using the wrench device described above. It is assumed that the lid is substantially round and is screwed on tightly, as is often the case with jars of food. The container may be, but is not necessarily, circular in cross-sectional shape. Instead it may be oval shaped, for instance, or even square.

The present method, which advantageously requires only a single wench device, preferably comprises the following steps:

(a) with the flexible member of the wrench device as described above, forming a snug loop around the container;

(b) grasping the container lid tightly between a left thumb and a left forefinger of the left hand; and (c) rotating the wrench device clockwise with the right hand, to rotate the container while firmly holding the lid stationary with the left hand.

In so doing, the rounded protrusion presses against the flexible member, firmly fixing it in position and preventing slippage of the flexible member loop with respect to the container as the wrench device is rotated.

The device may be easily removed from the container in an additional, final step by rotating the device counterclockwise with respect to the container to loosen the flexible member and then slipping the device off the top or bottom of the container.

Figure 3:
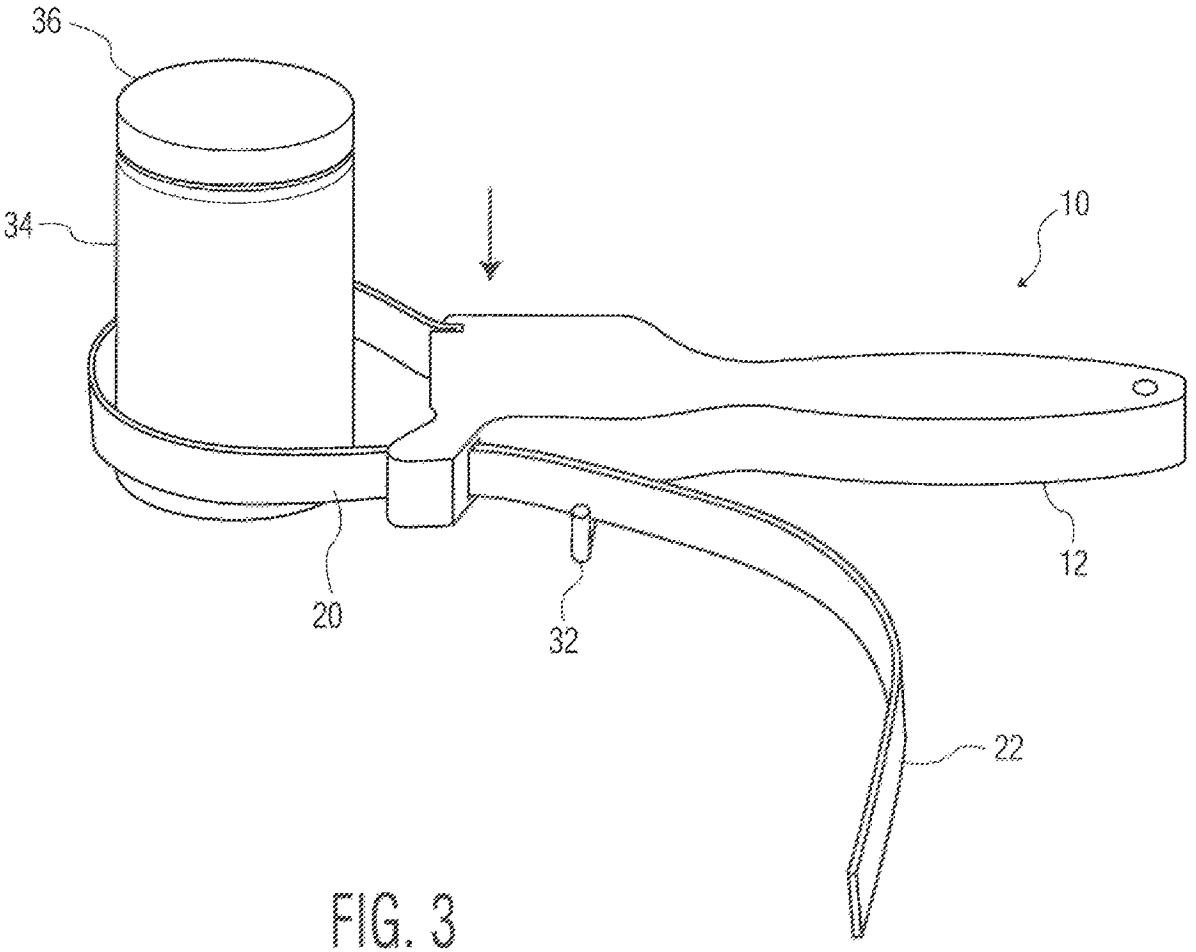
FIG. 3 is a perspective view of the wrench device of FIG. 1, showing a first step of the method for opening a jar in accordance with the present invention.
Figure 3A:
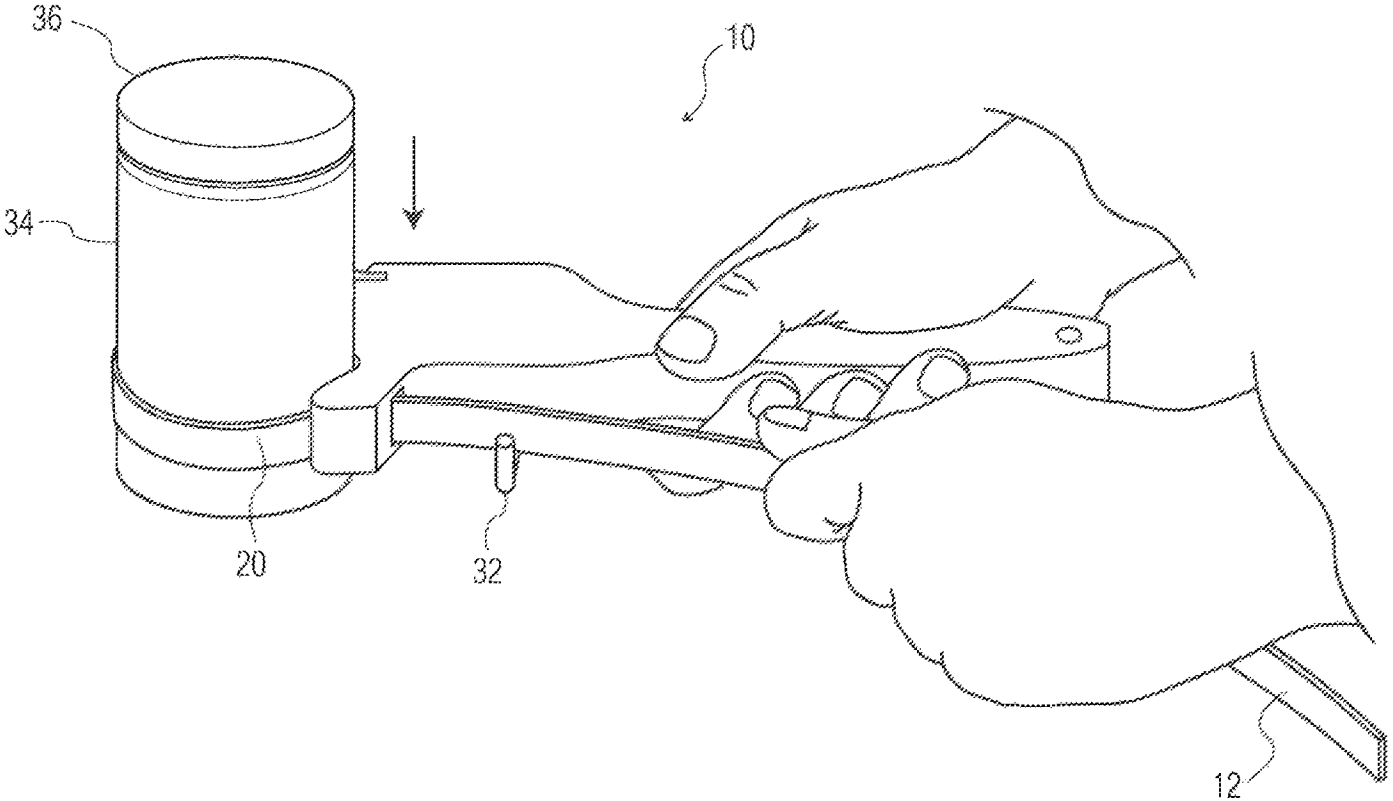
FIG. 3A is a perspective view of the wrench device of FIG. 1, showing a second step of the method for opening a jar.

FIG. 3-6 illustrate this method. FIG. 3 illustrates the initial position of the wrench device 10 with respect to a jar 34 with a lid 36. The flexible member 20 is conveniently slipped around the jar 34. As shown in FIG. 3A, the flexible member is then pulled snug with the left hand while holding the wrench handle with the right hand.

Figure 4:
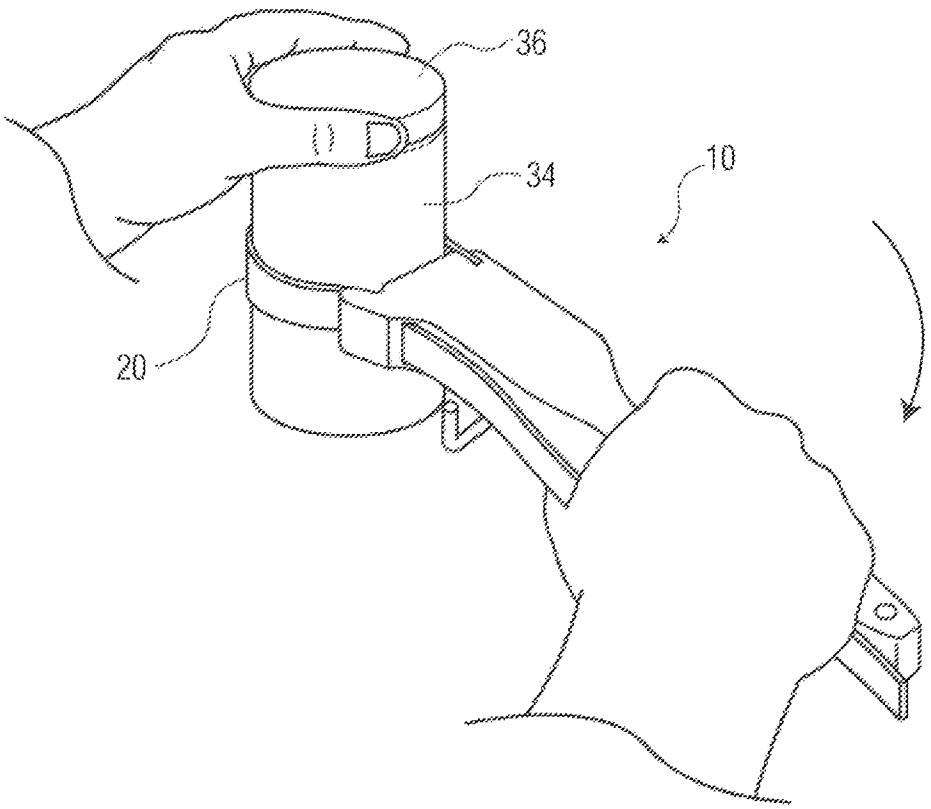
FIG. 4 is a perspective view showing a third step of a the method a jar.

As shown in FIG. 4, the user grasps the wrench handle with his/her right hand and simply "anchors" the round lid or cap 36 with the left. Surprising, with this technique only a minimal "squeezing" effort is required to hold the lid stationary against the application of the opposing torsional force applied to the jar by the wrench. When the jar is turned clockwise by the wrench device, with the lid thus held steady, even the tightest lid can be loosened and unscrewed.

Thanks to the "jamming" of the cap or lid surface into the natural arc of the user's left hand, as compared to the "pulling-away" action if the user tries to rotate the cap counterclockwise with the right hand, the "squeezing" effort by the user to hold the lid tight against rotation with the jar is quite insubstantial and can be easily accomplished by anyone, from the very young to the very old.

The free end of the strap can be held tightly when the wrench device is in use by squeezing it firmly against the handle proper. Such a firm grip on the strap is not necessary, however, because it is pressed against the jar 34 by the round protrusion 28.

Figure 5:
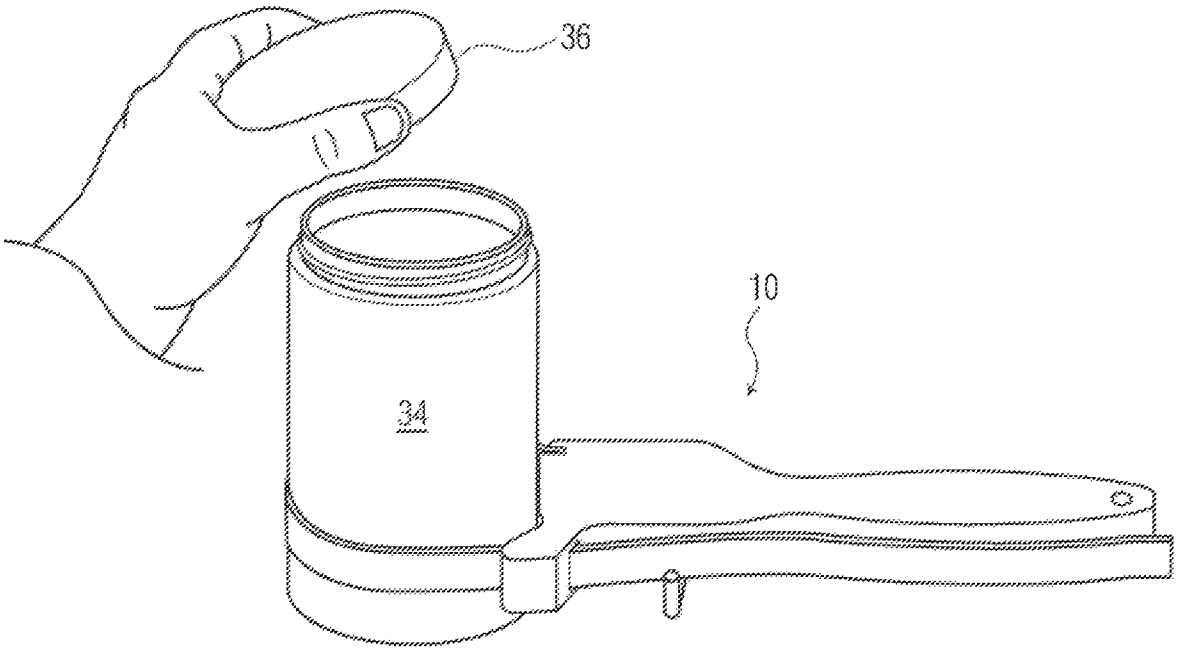
FIG. 5 is a perspective view showing a fourth step of the method for opening a jar.

In FIG. 5 the wrench device is held with the right hand while the lid is removed with the left hand. The thumb and forefinger create a circular grip around the lid.

Figure 6:
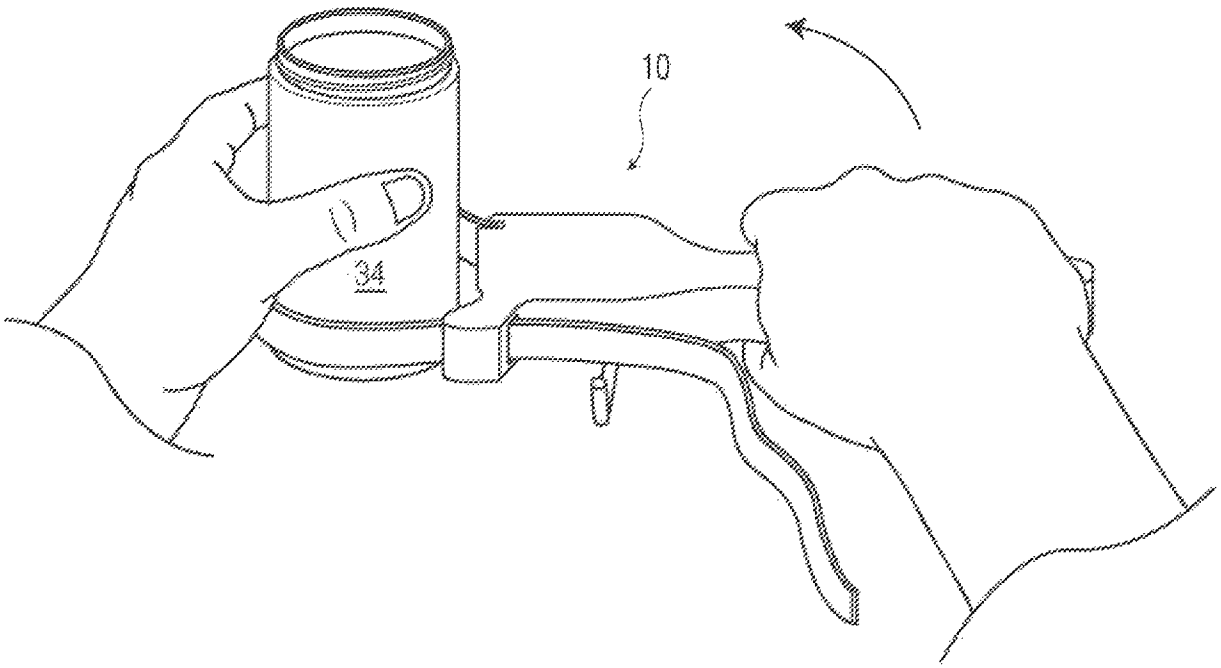
FIG. 6 is a perspective view showing a final step of the method for opening a jar.

In FIG. 6 the lid has been removed, and the flexible member of the wrench device is loosened to enable removal. Once it is loosened, the wrench device can easily be slipped off of the jar.

There has thus been shown and described a strap wrench device, as well a method for opening the lid of a container, both of which fulfill all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A wrench device for firmly gripping an object, said device comprising:

(a) an elongate, flexible member having a first end and a second end, said flexible member being configured to grip the object;

(b) an elongated handle having a proximal end having a base surface, a distal end, a face side extending in a first plane longitudinally to the distal end from a first edge of the base surface, back side extending in a plane parallel to the first plane and longitudinally to the distal end from a second edge opposite to the first edge, left side extending in a plane perpendicular to the first plane and longitudinally to the distal end from a third edge of the base surface, and right side extending perpendicular to the first plane and longitudinally to the distal end from a fourth edge opposite the third edge, said handle being configured to be held in a user's right hand with said proximal end extending toward said object to be gripped, said proximal end having an attachment component disposed adjacent said right side and configured to attach said first end of the flexible member and an opening adjacent said left side for passage of the flexible member, and (c) a guide member affixed to the left side of the handle and extending outwardly therefrom, the guide member disposed away from the proximal end and configured to retain the flexible member in close proximity to the left side of the handle, wherein said flexible member extends through said opening, thereby forming a loop, laying in a plane parallel to the first plane, that can surround and grip the object, and extends further along said left side of the handle toward said distal end; and wherein the handle includes a rounded protrusion that is fixed in place relative to the handle and extends from the proximal end, adjacent said opening and on a side thereof opposite to the attachment component, the rounded protrusion configured to press the flexible member against the object to prevent slippage of the loop with respect to the object when the handle is rotated clockwise, whereby the rounded protrusion fixes the flexible member in place between the protrusion and the object, and preventing slippage of the loop with respect to the object.

2. The wrench device defined in claim 1, wherein the flexible member is a substantially flat strap and wherein said opening is a slit which accommodates said strap, and wherein said opening is configured in a shape that is substantially identical to the strap.

3. The wrench device defined in claim 1, wherein the flexible member has a rubber surface to prevent slippage with respect to the object.

4. The wrench device as defined in claim 1, wherein the rounded protrusion is an elongate hump that extends from the face side to the back side of the handle.

5. The wrench device as defined in claim 1, wherein the handle is made of a hard plastic and the guide member is made of a metal.

6. A method for opening a container having tightly screwed thereon a substantially round lid, said method comprising the steps of:

(a) with the flexible member of the wrench device defined in claim 1, forming a snug loop around the container;

(b) grasping the container lid tightly between a left thumb and a left forefinger of the left hand; and (c) rotating the wrench device clockwise with the right hand, to rotate the container while firmly holding the lid stationary with the left hand, whereby the rounded protrusion fixes the flexible member between the protrusion and the object, and preventing slippage of the loop with respect to the object.

7. The method as defined in claim 6, further comprising the step of pressing the flexible member firmly against the left side of the handle with the fingers of the right hand while rotating the device clockwise with the container in step (c).

8. The method as defined in claim 6, further comprising an additional, final step of rotating the device counterclockwise with respect to the container to loosen the flexible member and allow removal of the device from the container.

9. The wrench device as defined in claim 1, wherein the protrusion is formed integrally with the handle.

* * * * *